United States Patent [19]

Masui et al.

[11] 4,065,298

[45] Dec. 27, 1977

[54] STEEL MAKING PROCESS BY OXYGEN TOP-BLOWN CONVERTER

[75] Inventors: Akira Masui, Kawasaki; Kenzo Yamada, Tokyo; Akinori Ninomiya, Yokohama; Katsuhiko Tachibana, Kamakura; Yoshihiro Kato, Yokohama, all of Japan

[73] Assignee: Nippon Kokan Kabushiki Kaisha, Tokyo, Japan

[21] Appl. No.: 643,840

[22] Filed: Dec. 23, 1975

[30] Foreign Application Priority Data

Dec. 28, 1974 Japan ..... 49-3519

[51] Int. Cl.[2] ..... C21C 5/32

[52] U.S. Cl. ..... 75/60

[58] Field of Search ..... 75/60

[56] References Cited

U.S. PATENT DOCUMENTS

| | | | |
|---|---|---|---|
| 3,015,554 | 1/1962 | Rummel | 75/60 |
| 3,898,077 | 8/1975 | Knuppel | 75/60 |
| 3,900,311 | 8/1975 | Nilles | 75/60 |

*Primary Examiner*—Peter D. Rosenberg

*Attorney, Agent, or Firm*—Flynn & Frishauf

[57] ABSTRACT

In a steel making process with an oxygen top-blown converter when a certain inclining angle ($\theta$) is given within a range of $0<\theta\leqq 15°$ to normal axis of an oxygen blow lance being supported at an upper portion of the lance and a certain number of rotation ($\nu$) is given within the range of $0<\nu\leqq 15$ rpm to the lance, the blow of oxygen is possible to be properly used as the refining reactions are advanced without any delay of slagging reaction and any stagnation of non-slagging lime during blowing.

2 Claims, 12 Drawing Figures

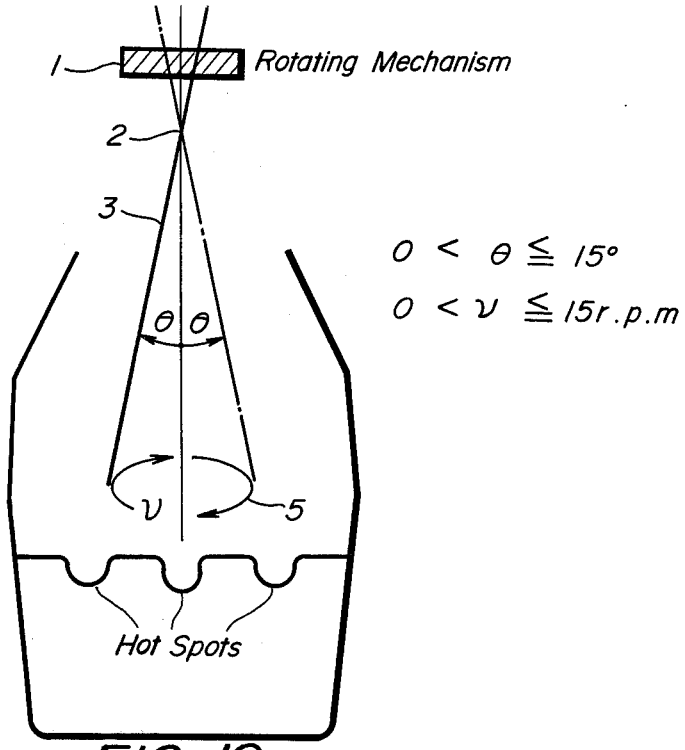
FIG_10
FIG_11
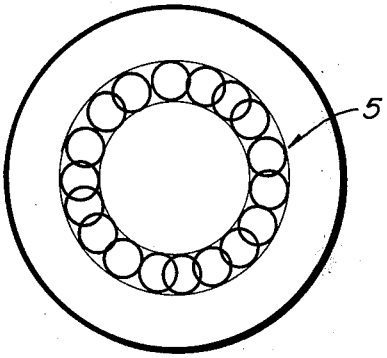
FIG_12
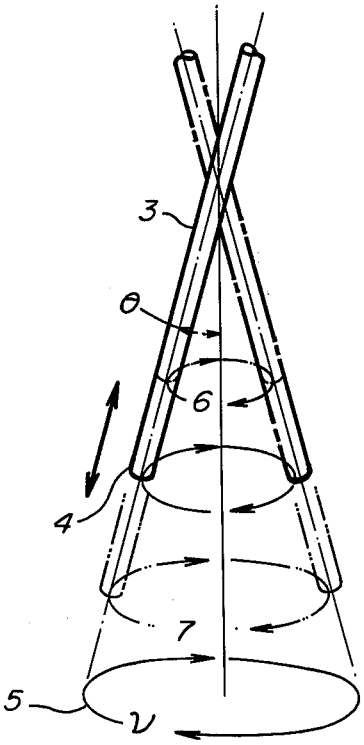

STEEL MAKING PROCESS BY OXYGEN TOP-BLOWN CONVERTER

The present invention concerns an improvement in a steel making process with an oxygen top-blown converter and particularly to a method of moving the hot spot during the blowing operation. More specifically, it facilitates a proper use of blowing practice corresponding to the variation in reaction by suitably controlling the inclining angle and rotational number of a lance during blowing.

In the LD converter process universally employed today, the slagging reaction tends to be delayed at the intermediate stage of the blowing period. Undissolved lime at this stage is not distributed homogeneously in the bath and it has little chance of entering the high temperature hot spot area during the blowing operation to dissolve, which lowers dephosphorizing and desulphurizing efficiency. This is well known as one defect of the LD method. Various improvements have been proposed to obviate this defect, for instance, those described in West German DAS 1 064 969 and Japanese Patent Publication No. 45-28 087. These improvements are both characterized in moving the hot spot, but the former is defective in the soft blow operation, while the latter is defective in the hard blow operation.

We have endeavoured to improve this defect of the LD method and have proposed the advantageous methods described in Japanese Patent Applications No. 48-109 806 and No. 49-20 427. In the former, the method is characterized in that the lance is maintained on a rotatable disc provided above the converter so that the blowing is performed along the normal in respect of the steel bath. In such a method, the rotating lance is maintained in a vertical relation against the surface of bath so that its maximum eccentric degree of the movement is limited to a value corresponding to the mouth diameter of the converter. Accordingly, the possibility of lime being unevenly distributed still remains. The latter method is basically characterized by the arrangement of ring-like porous brick or a plurality of nozzles in a ring manner on the periphery of furnace bottom to blow inert gas during the top-blowing of oxygen through the lance. It was found that porous plugs and nozzles arranged on the furnace bottom had a significant damaging impact on the life of the furnace itself in this latter method. Thus, the present situation is such that attempts to improve the LD method have encountered a number of difficulties.

The present invention was developed to overcome these difficulties and is characterized in that a suitable inclination angle and rotation are given to the lance which is further controlled corresponding to the progress of reaction thereof.

An object of this invention is to provide an oxygen top-blown operation method that is possible to be properly used with ease and stability as the reaction advances.

Another object of this invention is to provide an oxygen top-blown operation method wherein the delay of slagging reaction, particularly at the intermediate stage of blowing, is avoided.

A further object of this invention is to provide an oxygen top-blown operation method wherein uneven distribution of slagging limes is possible to be ravelled out.

Other objects and advantages will be apparent from the following description with the accompanying drawings in which:

FIG. 10 is a schematic diagram showing the operation carried out by the process according to the invention.

FIG. 11 is a top view of the surface of the hot metal, showing the locus of hot spots and progressing in a circle.

FIG. 12 is an embodiment showing vertical adjustment of the height of the lance rotating above the surface of the metal for providing the hard blow or soft blow of oxygen.

In the above figures, white circles and black circles show data of the claimed method and a conventional method, respectively.

Figure 1:
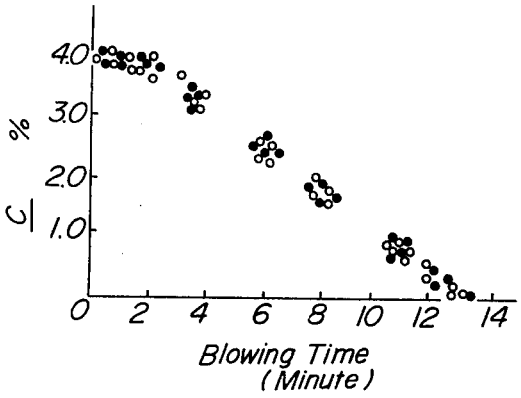
FIG. 1 is a graph showing progress of decarburizing reaction corresponding to blowing time.
Figure 2:
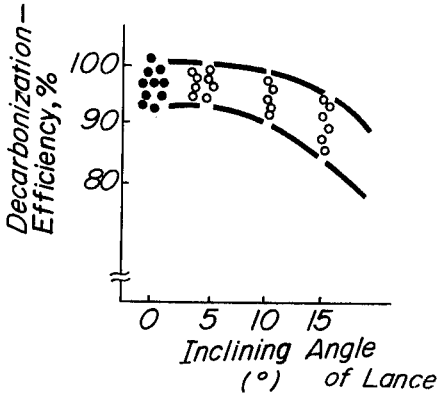
FIG. 2 shows the influence of the inclination angle of a lance on decarburizing efficiency.

In the present invention, a single type lance is used. The lance, however, may have a single or multiple hole nozzle. Such a lance has an inclination angle relative to its vertical axis and has a rotational number which may also be changed with a rotational mechanism. The present invention is primarily characterized as the said inclination $\theta$ is set within the range of $0 < \theta \leqq 15°$. Influence of this variable inclinating angle on the decarburizing efficiency was checked and the results are shown in FIGS. 1 and 2. In FIG. 1 the inclination of the lance is set at 4° and the blowing is performed at a set rotational number, 5 rpm. The thus obtained decarburizing reaction is compared with that of the conventional method. It will be appreciated that the decarburization efficiency in accordance with this invention is substantially the same as that of the conventional LD method. This fact substantiates the theory that features of the LD method are maintainable in the claimed process.

FIG. 2 shows the relation between the inclination of the lance (rotational number, 5 rpm) and decarbonization efficiency. As the angle increases, the said efficiency gradually decreases. When the angle exceeds 15°, the efficiency becomes so low that it should not be disregarded. Thus, the above range of $0 < \theta \leqq 15°$ was selected. Such an inclination angle should be selected within the above range and with regard to the shape and the capacity of the converter. However, there is an additional reason for the said range so set in accordance with the present invention. This is that the outer periphery of the hot spot area should not contact the furnace wall. If such a contact occurs, the furnace wall would be damaged sooner than it normally is damaged. The inclination angle of the lance thus selected under these requirements is suitably changed corresponding to the progress of reaction during blowing. More specifically, the control with the rotational movement of the lance to which reference is made below, as well as the control with the height of the lance practiced in the conventional method, may be applied in the operation of our method for a soft or hard blow condition and are exercised corresponding to the progress of reaction.

Figure 3:
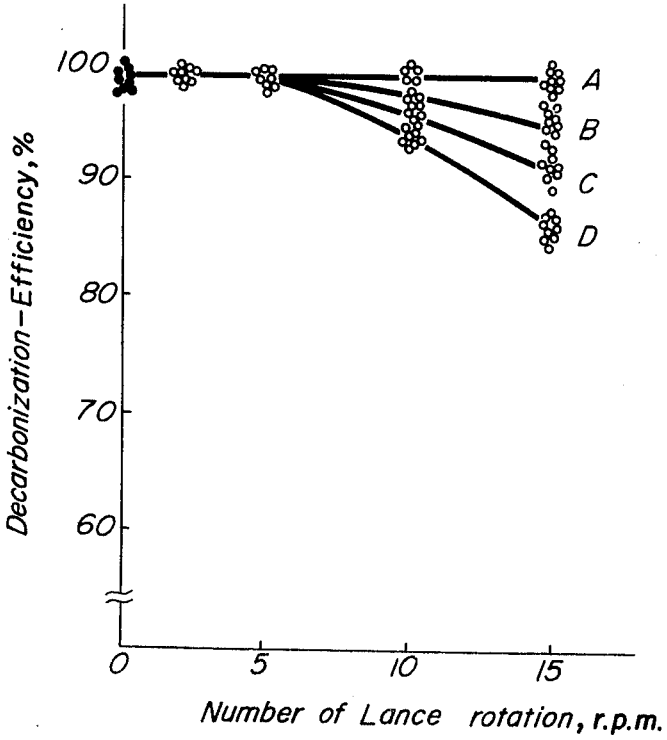
FIG. 3 shows the influence of rotational number of the lance on decarburizing efficiency.
Figure 4:
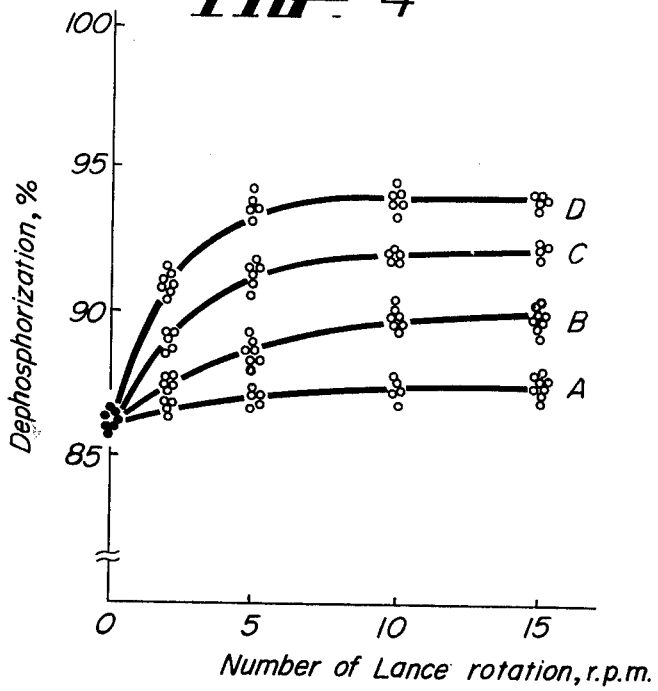
FIG. 4 shows change of dephosphorization efficiency by the number of rotations of a lance.
Figure 5:
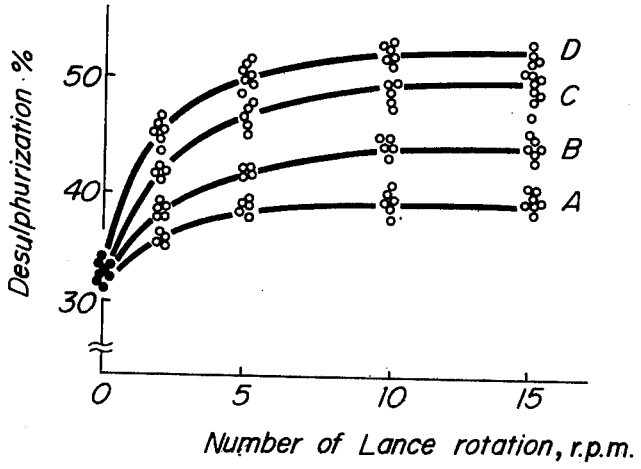
FIG. 5 shows change of desulphurization efficiency by the number of rotations of a lance.

Another feature of this invention is that the lower of the lance is rotated freely within the range of $0 < \nu \leqq 15$ rpm ($\nu$: rotational number). We have studied influences of the rotational number $\nu$ of the lance and the eccentric degree of the lance having the above inclination on refining reactions by conducting various experiments. The results are shown in FIGS. 3 to 5. Operational factors in these experiments are as follows.

P and S contents of the hot metal

| | |
|---|---|
| P: 0.15 | S: 0.035% |

Amount of lime used: 50 kg/TS

Eccentric rate of lance $\epsilon = (D_1/D_o) \times 100\%$ where, $D_1$ . . . diameter drawn by a hot spot made by the rotating lance $D_o$ . . . diameter of the bath surface in the furnace In the above drawings, Curve A . . . $\epsilon = 10\%$ Curve B . . . $\epsilon = 20\%$ Curve C . . . $\epsilon = 40\%$ Curve D . . . $\epsilon = 60\%$ Influences of the rotational number $\nu$ of the lance under the above mentioned factors were checked. Decarburization efficiency is shown in FIG. 3. As is seen from this Figure, decarburization efficiency remains the same in the range of eccentric degree up to the rotational number of 5 rpm of the lance. However, as the eccentric degree and the rotational number increase, decarburization efficiency decreases. Such a trend will indicate that the practical upper limit is set at the eccentric rate $\epsilon$ of 60% and the rotational number $\nu$ of 15 rpm.

FIGS. 4 and 5 show the relation between the rotational number of the lance and dephosphorization efficiency and desulphurization efficiency. These figures teach that both dephosphorization and desulphurization efficiency are improved in proportion to the eccentric degree and the rotational number. However, when the rotation number is 5 to 10 rpm, the improvement of both reactions becomes weaker and above 10 rpm is not significant. This demonstrates that a high speed rotation of above 15 rpm is almost meaningless for dephosphorization and desulphurization purposes. From the above-mentioned description of FIGS. 3 to 5, the reason for selecting the rotational number of the lance corresponding to the advance of reaction from within the range of $0 < \nu \leqq 15$ rpm will become clear.

Figure 6:
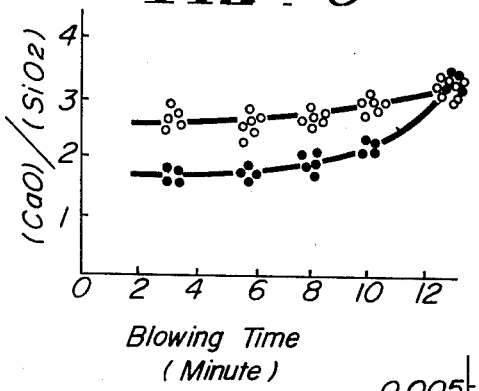
FIG. 6 is a graph showing a comparison of the change of basicity during blowing in a conventional method and in the claimed method.

Generally accepted percentages in the ordinary operations are 100% for decarburization efficiency, 86% for dephosphorization efficiency, and 33% for desulphurization efficiency. When the rotational lance is used under the conditions of $\epsilon = 60\%$, $\nu = 5$ rpm which fall within the range of the present invention, a radical improvement is seen in these figures; namely, 100% for decarburization efficiency, 93% for dephosphorization efficiency and 50% for desulphurization efficiency. Such an excellent blowing reaction becomes possible because of a rapid slagging reaction caused by a certain inclining angle and the rotation of the lance. Slagging reaction of the ordinary operation (basicity: 3.0 – 3.5) shown in FIG. 6, which with FIGS. 3–5 clearly demonstrates superiority of the slag formation rate of this invention as compared with the conventional method.

Figure 7:
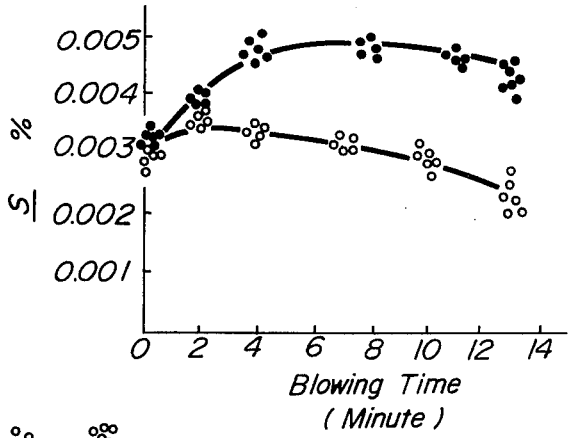
FIG. 7 shows change of sulphur content corresponding to blowing time in the case of ultra low sulphur steel production.
Figure 8:
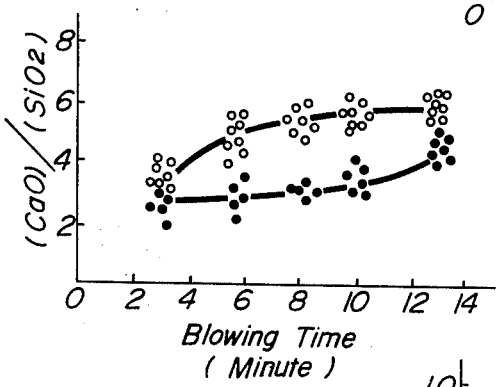
FIG. 8 is a graph showing change of basicity corresponding to blowing time in high basicity operation.
Figure 9:
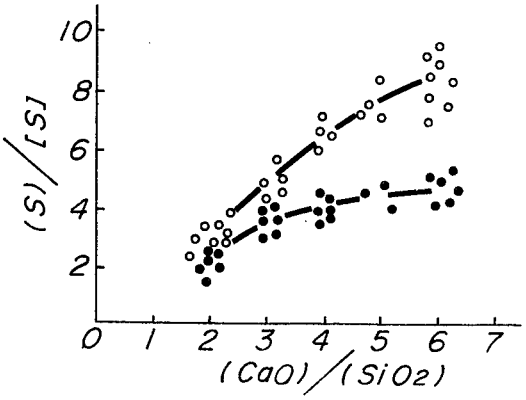
FIG. 9 shows sulphur distribution ratio ((S)/[S]) corresponding to changes of basicity.

The present invention has been applied to the production of ultra low sulphur steel and the result was compared with that of the conventional method. The results obtained are shown in FIG. 7. As will be seen from this Figure, in the ordinary LD method the sulphur content increases from 0.003% to about 0.005% after 4 minutes. In such a case, it is well known that a resulphurizing phenomenon tends to occur, with sulphur moving from lime to metal. However, the said resulphurization hardly occurs in the very low sulphur steel making process if it is carried out in accordance with the present method wherein a smooth advance of desulphurization is evident. As is clear from FIG. 8, the slag formation rate by this invention is incomparably faster than the conventional method; so fast that the slag of high basicity is substantially formed in the first period of blowing. At the same time, FIG. 9 indicates its usefulness in that (S)/[S] by this invention is larger than that of the conventional LD method and that the desulphurization rate of slag/metal interface is faster likewise even in the slag of the same basicity in case of producing the ultra low sulphur steel.

As shown in FIG. 10, 1 is a rotation mechanism for rotating lance 3 which is supported by a suitable support (not shown) at 2. The inclination angle $\theta$ of lance 3 is maintained within the range $0 < \theta \leqq 15°$ to the normal axis. The lower end (5) of lance 3 is rotated within the range of $0 < \gamma \leqq 15$ rpm, whereby the circular locus as shown in FIG. 11 is obtained.

If a soft blow operation is carried out for increasing total iron and facilitating dephosphorization, lance 3 is moved vertically to position 6 as shown in FIG. 12. Lance 3 is moved to position 7 to carry out a hard blow operation.

According to this invention, all the defects of the conventional method as above enumerated are thus resolved and further LD refining reactions can be controlled corresponding to the progress of reaction by controlling the height, the inclination angle, and the rotational number of lance.

We claim:

1. In a steel making process with an oxygen top blown converter wherein oxygen is blown in through a lance and wherein the hot spot formed by blowing is moved during blowing, the improvement which comprises maintaining the inclination angle ($\theta$) of the lance from the supporting point of its upper portion within the range of $0 < \theta \leqq 15°$ to the normal vertical axis, and maintaining the number of rotations of the lance ($\nu$) within the range of $0 < \nu \leqq 15$ rpm.

2. The steel making process as set forth in claim 1, wherein said inclination angle is so maintained to restrict the outer periphery of the area of said hot spot from contact with the furnace wall of said converter.

* * * * *

UNITED STATES PATENT AND TRADEMARK OFFICE

CERTIFICATE OF CORRECTION

PATENT NO. : 4,065,298

DATED : December 27, 1977

INVENTOR(S) : AKIRA MASUI et al

It is certified that error appears in the above-identified patent and that said Letters Patent are hereby corrected as shown below:

Title page, at "[30] Foreign Application Priority Data": replace "49-3519" with ---50-3519---.

Column 3, line 10: after "lower", insert ---end---.

Signed and Sealed this

*Third* Day of *October 1978*

[SEAL]

*Attest:*

RUTH C. MASON
*Attesting Officer*

DONALD W. BANNER
*Commissioner of Patents and Trademarks*